US008936078B2

(12) United States Patent
Richards

(10) Patent No.: US 8,936,078 B2
(45) Date of Patent: Jan. 20, 2015

(54) SHEARABLE CONTROL LINE CONNECTORS AND METHODS OF USE

(71) Applicant: Halliburton Energy Services, Inc., Houston, TX (US)

(72) Inventor: William Mark Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/937,354

(22) Filed: Jul. 9, 2013

(65) Prior Publication Data

US 2014/0144615 A1 May 29, 2014

Related U.S. Application Data

(63) Continuation of application No. PCT/US2012/066989, filed on Nov. 29, 2012.

(51) Int. Cl.
*E21B 29/04* (2006.01)

(52) U.S. Cl.
CPC ..... *E21B 29/04* (2013.01)
USPC ..... 166/242.6

(58) Field of Classification Search
USPC ..... 166/301, 376, 377, 242.6
See application file for complete search history.

(56) References Cited

U.S. PATENT DOCUMENTS

| | | | | |
|---|---|---|---|---|
| 4,490,002 | A | 12/1984 | Fowler | |
| 4,723,916 | A | 2/1988 | Fusselman et al. | |
| 6,626,582 | B2 | 9/2003 | Farrar et al. | |
| 6,726,369 | B1 | 4/2004 | Bates, III et al. | |
| 6,872,096 | B2 | 3/2005 | Baker | |
| 7,025,146 | B2 * | 4/2006 | King et al. | 166/374 |
| 7,594,763 | B2 | 9/2009 | Richards et al. | |
| 7,641,395 | B2 | 1/2010 | Ringgenberg et al. | |
| 7,717,725 | B2 | 5/2010 | Montena | |
| 2001/0045283 | A1 | 11/2001 | Leismer | |
| 2004/0065442 | A1 * | 4/2004 | Myerley et al. | 166/373 |
| 2012/0024543 | A1 * | 2/2012 | Head | 166/382 |
| 2012/0118561 | A1 * | 5/2012 | Frazier | 166/135 |

FOREIGN PATENT DOCUMENTS

| | | |
|---|---|---|
| EP | 0179579 A2 | 4/1986 |
| WO | 2014084826 | 6/2014 |

OTHER PUBLICATIONS

International Search Report and Written Opinion for PCT/US2012/066989 dated May 30, 2013.

* cited by examiner

*Primary Examiner* — Brad Harcourt
(74) *Attorney, Agent, or Firm* — McDermott Will & Emery LLP; Scott Richardson

(57) ABSTRACT

Disclosed are shearable control line connectors. One control line connector includes an upper coupling element, a lower coupling element communicably coupled to the upper coupling element, and a connector cap securing the upper coupling element to the lower coupling element and being configured to shear upon being subjected to an axial force, thereby effectively separating the upper coupling element from the lower coupling element.

22 Claims, 2 Drawing Sheets

SHEARABLE CONTROL LINE CONNECTORS AND METHODS OF USE

CROSS-REFERENCE TO RELATED APPLICATIONS

This application claims priority to and is a continuation application of International Application No. PCT/US2012/066989 filed on Nov. 29, 2012.

BACKGROUND

The present invention relates to downhole equipment and, in particular, to shearable control line connectors.

In the oil and gas industry, control lines are often run along the exterior of production tubing or work string extended into a wellbore in order to communicate between a surface location and a downhole location. The control lines, which may be optical, electrical, or fluid (i.e., hydraulic) control lines, enable the transmission of signals, downhole data acquisition, activation and control of downhole devices, and numerous other applications. For example, command and control signals may be sent from a controller located at the surface location to a downhole tool located within the wellbore. In other applications, downhole sensors collect data and relay that data to the surface location through a control line uplink for evaluation or use in the specific well-related operation. In yet other applications, hydraulic pressure is conveyed through the control lines to act on or otherwise actuate one or more downhole tools or devices.

When it is desired to retrieve certain downhole equipment from the wellbore, such as retrieving upper portions of a downhole completion assembly, the control lines are often severed, thereby allowing the upper portions to be successfully retrieved while leaving the remaining portions of the completion assembly downhole. In some cases, this may be done by pulling on the upper portions of the completion assembly until the control line fails in tension at a random location. In other cases, the control lines are severed using a shearing device located downhole and configured to sever the control line upon actuation.

At least one problem with severing control lines, however, is that the portions of the severed control line that remain downhole may inadvertently obstruct the portions of the equipment remaining downhole. Such an obstruction may prevent the remaining downhole equipment from being able to successfully connect to new or additional wellbore equipment subsequently introduced downhole. Moreover, if the remaining downhole equipment is ever required to be retrieved to the surface, the portions of the severed control line may bunch up within the wellbore and bind or otherwise prevent the ascent of the equipment to the surface.

SUMMARY OF THE INVENTION

The present invention relates to downhole equipment and, in particular, to shearable control line connectors.

In some embodiments, a control line connector is disclosed. The control line connector may include an upper coupling element, a lower coupling element communicably coupled to the upper coupling element, and a connector cap securing the upper coupling element to the lower coupling element, the connector cap being configured to shear upon being subjected to an axial force, thereby allowing the upper coupling element to separate from the lower coupling element.

In other embodiments, a method of severing a control line is disclosed. The method may include applying an axial force on a control line having an upper portion coupled to an upper coupling element and a lower portion coupled to a lower coupling element, the upper and lower coupling elements being communicably coupled together and secured with a connector cap, shearing the connector cap upon being subjected to the axial force, and separating the upper coupling element from the lower coupling element.

In yet other embodiments, a downhole system is disclosed. The downhole system may include an upper tubular coupled to a lower tubular at a shear joint, the shear joint comprising at least one shear device configured to fail upon being subjected to an axial force, a control line having an upper control line portion and a lower control line portion and extending along an exterior of the upper and lower tubulars, and a control line connector configured to communicably and physically couple the upper and lower portions of the control line, the control line connector comprising an upper coupling element coupled to the upper control line portion and a lower coupling element coupled to the lower control line portion, and a connector cap configured to secure the upper and lower coupling elements together and fail upon being subjected to the axial force, thereby allowing the upper and lower coupling elements to separate.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to downhole equipment and, in particular, to shearable control line connectors.

The embodiments disclosed herein may prove advantageous in providing a control line connector that is able to sever the control line at a known location within the wellbore upon being subjected to a predetermined axial force. Disconnecting or otherwise severing the control line at a predetermined location may prove advantageous in applications where it may be necessary to reconnect subsequently introduced downhole equipment with the lower portions of the wellbore equipment that remain downhole. By configuring the predetermined location below the remaining portions of the wellbore equipment, the lower portions of the control line following disconnection from the upper portions are unable to obstruct any incoming equipment from properly reconnecting to the lower portions of the wellbore equipment. Moreover, having the lower portions of the control line below the remaining portions of the wellbore equipment may prove advantageous in retrieving the lower wellbore equipment since the severed control line may not be able to bunch up and bind the wellbore equipment during its ascent to the surface. The various control line connectors disclosed herein may be configured to shear or otherwise yield upon being subjected to a predetermined axial force, thereby providing an operator with a reliable disconnection of the control line.

Figure 1A:
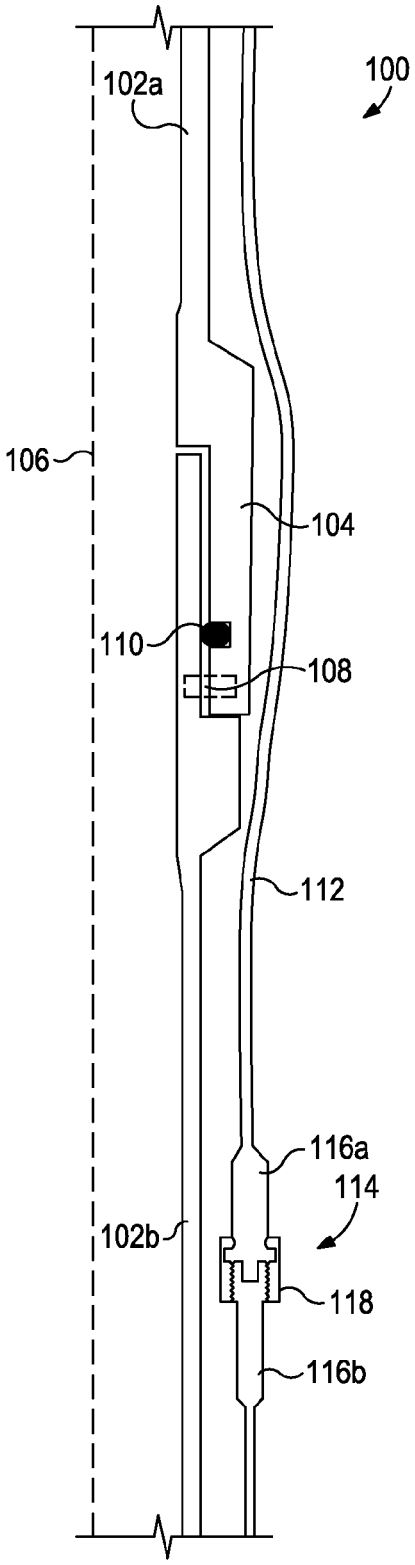
FIG. 1A illustrates a portion of a downhole system that uses an exemplary control line connector, according to one or more embodiments.

Referring to FIG. 1A, illustrated is a portion of a downhole system 100, according to one or more embodiments. In some embodiments, the downhole system 100 may be may be a downhole completion assembly, such as a gravel pack completion assembly used to prepare a wellbore for the production of oil and/or gas and subsequently facilitate such production therefrom. In other embodiments, however, the downhole system 100 may be any other downhole tubular system known to those skilled in the art. The illustrated portion of the downhole system 100 may encompass an upper tubular 102*a* coupled or otherwise attached to a lower tubular 102*b* at a shear joint 104. The upper and lower tubulars 102*a,b* may exhibit a central axis or centerline 106 and may be any type of downhole tubing known to those skilled in the art including, but not limited to, drill string, drill pipe, production tubing, work string, etc.

In some embodiments, the shear joint 104 may be arranged in the downhole system 100 below or otherwise downhole from one or more packers (not shown) but above or otherwise uphole from one or more screening devices (not shown), such as one or more sand screens. The shear joint 104 may include at least one shear device 108 arranged or otherwise disposed therein. The shear device 108 may be configured to extend at least partially into each of the first and second tubulars 102*a,b* and thereby secure the upper tubular 102*a* to the lower tubular 102*b*. In some embodiments, the shear device 108 may be a shear ring. In other embodiments, however, the shear device 108 may include one or more shear pins, one or more shear screws, or any other shearable device known to those skilled in the art. In any event, the shear device 108 may be configured to shear or otherwise break upon being subjected to a predetermined amount of axial force, as will be described below.

The shear joint 104 may further include one or more sealing elements 110. The sealing element 110 may be, for example, an o-ring or any other type of seal configured to or otherwise capable of fluidly sealing the connection between the upper and lower tubulars 102*a,b*. The sealing element 110, or another substantially similar sealing element, may be used to re-seal the connection at the shear joint 104 after the upper and lower tubulars 102*a,b* are separated and either reconnected or another tubular member is subsequently coupled to the lower tubular 102*b*.

The downhole system 100 may further include at least one control line 112 extending along the exterior of the upper and lower tubulars 102*a,b*. In some embodiments, the control line 112 may extend from a surface location (not shown) to the downhole system 100. In other embodiments, the control line 112 may extend from another location intermediate the surface location and the downhole system, without departing from the scope of the disclosure. While not shown, it will be appreciated that the control line 112 may be secured or otherwise attached to the downhole system 100 at several points using one or more clamps or other securing devices (not shown).

The control line 112 may extend from the surface of the wellbore in order to communicably couple the surface location with one or more downhole tools or devices (not shown), such as one or more tools associated with the downhole system 100. In some embodiments, the control line 112 may convey or otherwise provide a conduit for one or more fiber optic lines extended from the surface location. In other embodiments, the control line 112 may convey or otherwise provide a conduit for one or more electrical lines or one or more hydraulic lines extended from the surface location. In yet other embodiments, the control line 112 may be a combination of one or more fiber optic, electric, and/or hydraulic lines, without departing from the scope of the disclosure. For instance, the control line 112 may be a flatpack physical link between surface control systems and downhole equipment, as generally known in the art.

The control line 112 may include a control line connector 114 configured to connect or otherwise couple two opposing lengths or segments of the control line 112 such that the overall length of the control line 112 is effectively extended. In one or more embodiments, the control line connector 114 may include a first or upper coupling element 116*a* communicably coupled to a second or lower coupling element 116*b*. In at least one embodiment, a connector cap 118 may be used to secure the upper coupling element 116*a* to the lower coupling element 116*b*. In some embodiments, the connector 114 may be characterized as a dry mate connector. In other embodiments, the connector 114 may be characterized as a wet mate connector, without departing from the scope of the disclosure. In some embodiments, the connector 114 may be encased within a housing or other type of protective casing (not shown) configured to generally protect the connector 114 from inadvertent damage as it is introduced into a wellbore.

Figure 1B:
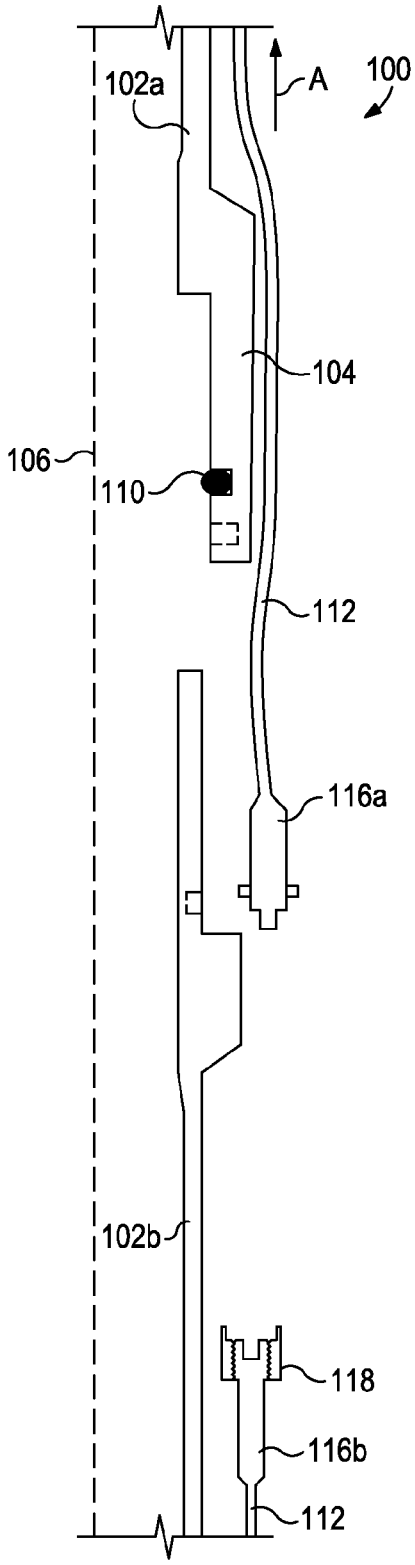
FIG. 1B illustrates the downhole completion assembly of FIG. 1A as separated at an exemplary shear joint, according to one or more embodiments.

Referring now to FIG. 1B, when it is desired to separate the upper and lower tubulars 102*a,b* at the shear joint 104, an axial force may be applied on the upper tubular 102*a* in the upward or uphole direction, as indicated by arrow A. This axial force in the uphole direction A may be increased until reaching a predetermined limit or threshold at which point the shear device 108 may be configured to yield, thereby allowing the upper tubular 102*a* to separate from the lower tubular 102*b* and ascend in the uphole direction A while the lower tubular 102*b* remains stationary.

Pulling the upper tubular 102*a* in the uphole direction A may also be configured to subject the control line 112 to the same axial force, and thereby eventually cause a separation of the control line 112 at the control line connector 114. Specifically, upon experiencing the axial force in the uphole direction A, the connector 114 may be configured to shear or otherwise break, thereby effectively separating the upper coupling element 116*a* from the lower coupling element 116*b*. In at least one embodiment, the connector cap 118 may be configured to shear or otherwise break in order to separate the upper and lower coupling elements 116*a,b*. With the upper and lower coupling elements 116*a,b* successfully separated, the upper tubular 102*a* may be free to ascend toward the surface unobstructed.

As illustrated, in some embodiments, the control line connector 114 may be arranged or otherwise disposed below or downhole from the shear joint 104. This may prove advantageous in applications where it is desired to subsequently locate the lower tubular 102*b* and reconnect a tubular or other downhole tool or assembly thereto at the shear joint 104. Since the lower portion of the control line 112 is disposed below the shear joint 104, such remaining portions of the control line are unable to obstruct the lower tubular 102*b* for the receipt of any incoming downhole tool or assembly.

In embodiments where the control line connector 114 is a wet mate connector, for example, the upper and lower coupling elements 116*a,b* may be subsequently reattached. Specifically, a new upper coupling element (not shown) may be introduced into the wellbore and may be configured to re-establish communication between the conveyance medium (i.e., fiber optic lines, electrical lines, hydraulic lines, etc.) enclosed within the control line 112.

Figure 2:
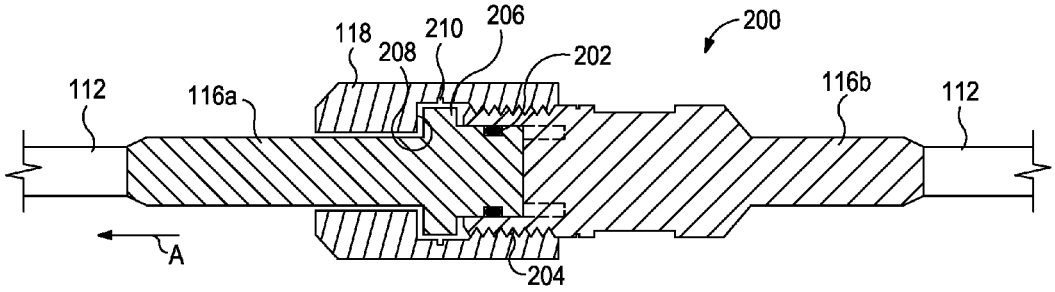
FIG. 2 illustrates a partial cross-sectional view of an exemplary control line connector, according to one or more embodiments.

Referring now to FIG. 2, illustrated is a partial cross-sectional view of an exemplary control line connector 200, according to one or more embodiments. The control line connector 200 may be similar in some respects to the control line connector 114 of FIGS. 1A and 1B and therefore may be best understood with reference thereto where like numerals represent like elements that will not be described again in detail. As illustrated, the upper coupling element 116*a* of the connector 200 may be coupled or otherwise attached to an upper portion of the control line 112 (i.e., to the left in FIG. 2) and the lower coupling element 116*b* of the connector 200 may be coupled or otherwise attached to a lower portion of the control line 112 (i.e., to the right in FIG. 2). In some embodiments, the control line 112 may be made of stainless steel or a nickel alloy, for example, and the upper and lower coupling elements 116*a,b* may be welded or otherwise brazed to the control line 112 at each respective end. In other embodiments, however, the upper and lower coupling elements 116*a,b* may be attached to the respective portions of the control line 112 using other fastening techniques including, but not limited to, mechanical fasteners, SWAGELOK®-type connectors, threading, industrial adhesives, combinations thereof, or the like.

The upper and lower coupling elements 116*a,b* may be communicably and physically coupled to each other. As will be appreciated, the upper and lower coupling elements 116*a,b* may be configured connect upper and lower portions of the control line 112 such that the conveyance medium enclosed therein (i.e., fiber optic lines, electrical lines, hydraulic lines, etc.) is effectively interconnected across the connective joint. The particulars of such a connection is beyond the scope of this disclosure, and therefore will not be illustrated or described in any detail. In some embodiments, one or more sealing elements 202 may be arranged between the upper and lower coupling elements 116*a,b* and configured to seal the connection between the two components. In some embodiments, the sealing element 202 may be, for example, an o-ring or any other seal configured to fluidly seal the connection between the upper and lower coupling elements 116*a,b*.

In one or more embodiments, the connector cap 118 may be configured to secure the connection between the upper and lower coupling elements 116*a,b*. In some embodiments, the connector cap 118 may be operatively or movably attached to the upper coupling element 116*a* and threadably attached to the lower coupling element 116*b* via corresponding threads 204 defined on the inner surface of the connector cap 118 and the outer surface of the lower coupling element 116*b*. In other embodiments, however, the connector cap 118 may be fastened to the lower coupling element 116*b* using other techniques including, but not limited to, mechanical fasteners, welding or brazing techniques, industrial adhesives and/or epoxies, combinations thereof, or the like.

It should be noted that the use of the terms "upper" and "lower" with respect to the upper and lower coupling elements 116*a,b* should not be considered limiting to the scope of the disclosure. Rather, the connector cap 118 may equally be operatively or movably attached to the lower coupling element 116*b* and threadably attached to the upper coupling element 116*a* via corresponding threads defined on the inner surface of the connector cap 118 and the outer surface of the upper coupling element 116*b*, without departing from the scope of the disclosure. Indeed, directional orientation of either upper or lower coupling element 116*a,b*, or how the connector cap 118 secures the two together, may vary from application to application, and nonetheless remain within the scope of this disclosure.

As illustrated, in at least one embodiment, the upper coupling element 116*a* may define a radial shoulder 206 configured to engage an inner axial surface 208 of the connector cap 118. As the connector cap 118 is threaded onto the lower coupling element 116*b*, the inner axial surface 208 may bias the radial shoulder 206 and force the upper coupling element 116*a* into connecting engagement with the lower coupling element 116*b*.

The connector cap 118 may define at least one shear groove 210. In some embodiments, as illustrated, the shear groove 210 may be defined on or otherwise machined into the inner radial surface of the connector cap 118. In other embodiments, however, the shear groove 210 may equally be defined or otherwise machined on the outer radial surface of the connector cap 118, without departing from the scope of the disclosure. The shear groove 210 may provide a location on the connector cap 118 where a portion of the connector cap 118 is thinned such that the thinned portion may yield or otherwise fail at an approximate predetermined load. In some embodiments, the shear groove 210 may be defined such that the predetermined failure load of the connector cap 118 is known. For instance, in at least one embodiment, the connector cap 118 may fail at a predetermined load in the range from about 1000 lbf to about 1500 lbf. In other embodiments, however, the predetermined failure load may be more or less, without departing from the scope of the disclosure. As a result, an operator may be able to determine approximately how much axial force may need to be applied to the connector cap 118 in order for it to yield or fail.

As the upper portion of the control line 112, including the upper coupling element 116*a*, is pulled in the uphole direction A, as generally described above with reference to FIGS. 1A and 1B, the axial force is transmitted from the upper coupling element 116*a* to the connector cap 118. More specifically, the axial force may be transmitted from the radial shoulder 206 to the inner axial surface 208 of the connector cap 118. Once the axial force applied on the control line 112 reaches or otherwise surpasses the predetermined shear value, the connector cap 118 may be configured to shear at the shear groove 210, thereby effectively separating the upper coupling element 116*a* from the lower coupling element 116*b*.

In other embodiments, the upper coupling element 116*a* may be separated from the lower coupling element 116*b* upon overcoming the threading 204 between the connector cap 118 and the lower coupling element 116*b*. For instance, the connector cap 118 may be made of a material that is generally softer than the material of the lower coupling element 116*b*. In some embodiments, the connector cap 118 may be made of brass, for example, or some other "soft" material, and the lower coupling element 116*b* may be made of one or more steel alloys, such as INCONEL®, for example, or some other "hard" material. As a result, as the axial force is transmitted from the radial shoulder 206 to the inner axial surface 208 of the connector cap 118, the threading 204 corresponding to the connector cap 118 may fail, thereby also effectively separating the upper coupling element 116*a* from the lower coupling element 116*b*.

Figure 3:
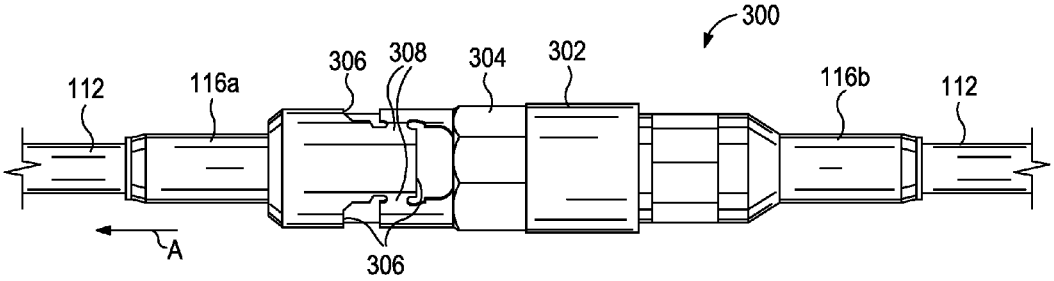
FIG. 3 illustrates another exemplary control line connector, according to one or more embodiments.

Referring now to FIG. 3, illustrated is another exemplary control line connector 300, according to one or more embodiments. The control line connector 300 may be similar in some respects to the control line connector 200 of FIG. 2 and therefore may be best understood with reference thereto where like numerals represent like elements not described again in detail. As illustrated, the upper and lower coupling elements 116*a,b* may again be communicably and physically coupled to each other. Moreover, the upper and lower coupling elements 116*a,b* may be secured together using a connector cap 302. The connector cap 302 may be substantially similar to the connector cap 118 of FIGS. 1A, 1B, and 2 and therefore may be best understood with reference thereto.

Similar to the connector cap 118 of FIG. 2, the connector cap 302 may be threaded onto the lower coupling element 116*b* via corresponding threadings (not shown) defined on an inner surface of the connector cap 302 and the outer surface of the lower coupling element 116*b*. The hexagonal wrench fitting 304 defined on the connector cap 302 may help facilitate the threading process. As will be appreciated, however, the connector cap 302 may equally be fastened to the lower coupling element 116*b* using other techniques including, but not limited to, mechanical fasteners, welding or brazing techniques, industrial adhesives, combinations thereof, or the like.

Unlike the connector cap 118 of FIG. 2, however, the connector cap 302 may define or otherwise provide one or more windows 306 configured to reduce the overall strength of the connector cap 302. In the illustrated embodiment, four windows 306 (three shown in FIG. 3) are defined in the body of the connector cap 302. It will be appreciated, however, that more or less than four windows 306 may be defined in the connector cap 302, without departing from the scope of the disclosure. Moreover, while FIG. 3 depicts the windows 306 having a particular geometry or shape, those skilled in the art with the benefit of this disclosure will readily appreciate that the windows 306 may equally be defined using several other geometries or shapes.

The connector cap 302 may further provide one or more shear points 308 that may separate or otherwise isolate the one or more windows 306 from each other. The shear points 308 may be generally small portions or segments of the connector cap 302 that are configured to yield or otherwise fail at a predetermined load as applied to the connector cap 302. In some embodiments, the shear points 308 may be machined or otherwise provided such that the predetermined failure load of the connector cap 302 is known. For instance, in at least one embodiment, the predetermined failure load may range from about 300 lbf to about 500 lbf. In other embodiments, however, the predetermined failure load may be more or less, without departing from the scope of the disclosure. As will be appreciated, the predetermined failure load may correspondingly increase or decrease in relation to the size and shape of the windows 306 and the size of the shear points 308.

In exemplary operation, as the upper portion of the control line 112, including the upper coupling element 116*a*, is pulled in the uphole direction A, as generally described above with reference to FIGS. 1A and 1B, the axial force is transmitted from the upper coupling element 116*a* to the connector cap 302 (e.g., such as through a transfer from the radial shoulder 206 to the inner axial surface 208, as described above in FIG. 2). Once the axial force applied on the control line 112 reaches or otherwise surpasses the predetermined shear value or failure load, the connector cap 302 may be configured to shear at the shear points 308, thereby destroying the integrity of the connector cap 302 and allowing the upper coupling element 116*a* to separate from the lower coupling element 116*b*.

In other embodiments, the upper and lower coupling elements 116*a,b* may be effectively separated as a result of axial compression on the control line 112. For example, in at least one embodiment, the connector cap 302 may be configured to fail or otherwise yield when an axial force is applied on the control line 112 in a direction opposite that of the direction A. Once the axial compression force applied on the control line 112 reaches or otherwise surpasses the predetermined shear value, the shear points 308 may yield or otherwise fail, thereby collapsing the one or more windows 306 and releasing the connector cap 302 from engagement with the lower coupling element 116*b*. As a result, the upper coupling element 116*a* may be effectively separated from the lower coupling element 116*b*.

Figure 4:
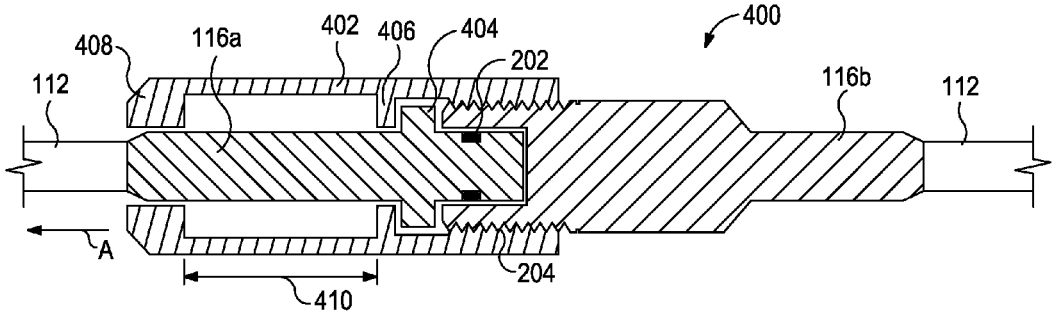
FIG. 4 illustrates a partial cross-sectional view of another exemplary control line connector, according to one or more embodiments.

Referring now to FIG. 4, illustrated is another exemplary control line connector 400, according to one or more embodiments. The control line connector 400 may be similar in some respects to the control line connectors 200 and 300 of FIGS. 2 and 3, respectively, and therefore may be best understood with reference thereto where like numerals represent like elements that will not be described again in detail. As illustrated, the upper and lower coupling elements 116*a,b* may again be communicably and physically coupled to each other and secured thereto using a connector cap 402. The connector cap 402 may be substantially similar to the connector cap 118 of FIG. 2 and therefore may be best understood with reference thereto.

As illustrated, the upper coupling element 116*a* may define a radial shoulder 404 configured to engage a radial protrusion 406 machined into or otherwise attached to the inner radial surface of the connector cap 402. As the connector cap 402 is threaded onto the lower coupling element 116*b*, the radial protrusion 406 may be configured to bias the radial shoulder 404 and force the upper coupling element 116*a* into connecting engagement with the lower coupling element 116*b*. As will be appreciated, however, the connector cap 402 may equally be fastened to the lower coupling element 116*b* using other techniques including, but not limited to, mechanical fasteners, welding or brazing techniques, industrial adhesives, combinations thereof, or the like.

In some embodiments, the radial protrusion 406 may be a shearable ring configured to yield or otherwise break when subjected to a predetermined shear value as applied through forced engagement with the radial shoulder 404. In other embodiments, the radial protrusion 406 may be or otherwise encompass one or more shear screws or shear pins installed on the inner radial surface of the connector cap 402 and may be equally configured to yield or otherwise break when subjected to the predetermined shear value, without departing from the scope of the disclosure.

The connector cap 402 may also define an axial stop element 408 that may be axially offset from the radial protrusion 406 by a predetermined distance 410. In some embodiments, the axial stop element 408 may be a portion of the connector cap 402 that extends radially inward, as illustrated. In other embodiments, however, the axial stop element 408 may be an annular attachment or washer device coupled to the interior of the connector cap 402.

In exemplary operation, as the upper portion of the control line 112, including the upper coupling element 116*a*, is pulled in the uphole direction A, as generally described above with reference to FIGS. 1A and 1B, the axial force is transmitted from the upper coupling element 116*a* to the connector cap 402. In particular, the axial force applied on the upper coupling element 116*a* may be transmitted from the radial shoulder 404 to the radial protrusion 406 via their mutual axial engagement. Once the axial force applied on the control line 112 reaches or otherwise surpasses the predetermined shear value of the radial protrusion 406, the radial protrusion 406 may be configured to yield or otherwise shear, thereby allowing the upper coupling element 116*a* to translate axially within the connector cap 402 until engaging the axial stop element 408 and thereby stopping its axial movement.

While the upper coupling element 116*a* may be able to physically separate from the lower coupling element 116*b* when the radial protrusion 406 yields, the upper coupling element 116*a* may nonetheless remain captured within or otherwise coupled to the connector cap 402 as a result of the axial stop element 408. Those skilled in the art will appreciate the advantages this may provide. For instance, the control line connector 400 may be employed in applications that require only a small axial separation between the upper and lower coupling elements 116*a,b* but where it is not desired to separate the two ends of the control line 112 so as to avoid the lower portion of the control line 112 from obstructing future downhole operations.

In one application, for example, the control line connector 400 may be a dry mate connector used when retrieving or otherwise repositioning a packer element (not shown) from a wellbore. The packer element may be, for example, a bypass packer element that facilitates the upper portion of the control line 112 to pass therethrough. Such bypass retrievable packers are known to often increase in axial length as they are being retrieved or otherwise repositioned. Such an increase in axial length directly affects any control lines 112 running therethrough, which will also be pulled and stretched upon retrieval. As will be appreciated, the predetermined distance 410 may vary depending on the required axial displacement for the particular application.

By placing the control line connector 400 below such a retrievable packer and allowing it to break or otherwise yield (as generally described above) below the packer when it is released, the predetermined distance 410 allows the upper coupling element 116*a* to physically separate from the lower coupling element 116*b*, but simultaneously be retained within the connector cap 402. As a result, when the retrievable packer is pulled, the control line 112 is disconnected at the control line connector 400 but the lower portions thereof are unable to cause obstructions to the lower equipment.

Those skilled in the art will readily appreciate the advantages this may provide. For example, if the control line 112 were to break at a random location in the wellbore, the lower, free end portion of the control line 112 may have sufficient length to lay against the casing within the wellbore. As the packer is being pulled toward the surface, the control line 112 may then begin to ball up or "bird nest" between the lower tubular 102*b* and the casing. The accumulated ball of control line 112 may then potentially wedge the lower tubular 102*b* in place, thereby preventing its retrieval. Moreover, the ball of control line 112 may start pulling additional control line 112 out of secured engagement with the lower tubular 102*b*, breaking clamps along the length of the lower tubular 102, and thereby adding debris to the wellbore that also serves to prevent retrieval of lower tubular 102*b*.

According to the present disclosure, however, the control line connector 400 may provide a predetermined and discrete location for the control line 112 to separate upon being subjected to the predetermined axial force. In some embodiments, clamps (not shown) can be provided at advantageous locations along the upper and lower tubulars 102*a,b* to protect the separated control line connector 400. In this way the control line connector 400 may prove advantageous in helping facilitate the effective retrieval of packers and related completion equipment with the control lines 112.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A control line connector, comprising:

an upper coupling element configured to be coupled to an upper portion of a control line extending along an exterior of a downhole tubing, the upper coupling element providing a shoulder that extends radially outward from the upper coupling element;

a lower coupling element communicably coupled to the upper coupling element and configured to be coupled to a lower portion of the control line extending along the exterior of the downhole tubing; and a connector cap that extends at least partially about the upper and lower coupling elements to secure the upper coupling element to the lower coupling element, the connector cap providing a protrusion extending radially inward from the connector cap and defining an axial surface engageable with the shoulder, wherein, upon subjecting the connector cap to an axial force, the axial surface engages the radial shoulder and the connector cap fails, thereby allowing the upper coupling element to separate from the lower coupling element.

2. The control line connector of claim 1, wherein the connector cap is operatively attached to the upper coupling element and threadably attached to the lower coupling element in order to secure the upper coupling element to the lower coupling element.

3. The control line connector of claim 2, wherein the axial force shears threading between the connector cap and the lower coupling element, thereby allowing the upper coupling element to separate from the lower coupling element.

4. The control line connector of claim 1, further comprising:

at least one shear groove defined on the connector cap and configured to fail upon the connector cap being subjected to the axial force engagement between the radial shoulder and the inner axial surface.

5. The control line connector of claim 4, wherein the at least one shear groove is defined on at least one of an inner radial surface of the connector cap and an outer radial surface of the connector cap.

6. The control line connector of claim 1, further comprising:

one or more windows defined in the connector cap; and one or more shear points defined on the connector cap to separate the one or more windows from each other, the one or more shear points being configured to fail upon being subjected to the axial force.

7. The control line connector of claim 6, wherein the axial force is at least one of a tensile force applied to a control line coupled to the upper coupling element and a compressive force applied to a control line coupled to the upper coupling element.

8. The control line connector of claim 1, further comprising:

an axial stop element extending radially inward from the connector cap and axially offset from the protrusion, the axial stop element being configured to stop axial movement of the upper coupling element within the connector cap following failure of the protrusion.

9. The control line connector of claim 8, wherein the protrusion is at least one of a shearable ring, one or more shear pins, and one or more shear screws.

10. A method of severing a control line, comprising:

applying an axial force on a control line extending along an exterior of a downhole tubing, the control line having an upper portion coupled to an upper coupling element and a lower portion coupled to a lower coupling element, the upper and lower coupling elements being communicably coupled together and secured with a connector cap that extends at least partially about the upper and lower coupling elements;

shearing the connector cap upon being subjected to the axial force, wherein the upper coupling element provides a shoulder that extends radially outward from the upper coupling element, and the connector cap provides a protrusion extending radially inward from the connector cap and defining an axial surface engageable with the shoulder; and separating the upper coupling element from the lower coupling element.

11. The method of claim 10, wherein shearing the connector cap comprises shearing threading between the connector cap and the lower coupling element, the threading being configured to couple the connector cap to the lower coupling element.

12. The method of claim 10, further comprising:

forcing the shoulder into engagement with the axial surface upon subjecting the control line to the axial force; and shearing at least one shear groove defined on the connector cap.

13. The method of claim 10, wherein the connector cap defines one or more windows and one or more shear points configured to separate the one or more windows from each other, wherein shearing the connector cap comprises shearing the one or more shear points upon being subjected to the axial force.

14. The method of claim 10, wherein shearing the connector cap comprises:

engaging the shoulder on the axial surface of the protrusion;

shearing the protrusion with the shoulder upon the upper coupling element being subjected to the axial force;

disconnecting the upper coupling element from the lower coupling element; and stopping an axial movement of the upper coupling element with an axial stop element defined on the connector cap and axially offset from the radial protrusion.

15. A downhole system, comprising:

an upper tubular coupled to a lower tubular at a shear joint, the shear joint comprising at least one shear device configured to fail upon being subjected to an axial force;

a control line having an upper control line portion extending along an exterior of the upper tubular and a lower control line portion extending along an exterior of the lower tubular;

a control line connector that communicably and physically couples the upper and lower portions of the control line, the control line connector comprising an upper coupling element coupled to the upper control line portion and a lower coupling element coupled to the lower control line portion, the upper coupling element providing a shoulder that extends radially outward from the upper coupling element; and a connector cap that extends at least partially about the upper and lower coupling elements to secure the upper and lower coupling elements together, the connector cap providing a protrusion extending radially inward from the connector cap and defining an axial surface engageable with the shoulder, wherein, upon subjecting the connector cap to an axial force, the axial surface engages the radial shoulder and the connector cap fails, thereby allowing the upper and lower coupling elements to separate.

16. The downhole system of claim 15, wherein the connector cap is threaded to the lower coupling element to secure the upper coupling element to the lower coupling element.

17. The downhole system of claim 16, wherein the axial force shears threading between the connector cap and the upper or lower coupling element, thereby separating the upper coupling element from the lower coupling element.

18. The downhole system of claim 15, further comprising:

at least one shear groove defined on the connector cap and configured to fail upon the connector cap being subjected to the axial force engagement between the shoulder and the axial surface.

19. The downhole system of claim 18, wherein the at least one shear groove is defined on at least one of an inner radial surface of the connector cap and an outer radial surface of the connector cap.

20. The downhole system of claim 15, further comprising:

one or more windows defined in the connector cap; and one or more shear points defined on the connector cap to separate the one or more windows from each other, the one or more shear points being configured to fail upon being subjected to the axial force.

21. The downhole system of claim 15, further comprising:

an axial stop element defined on the connector cap and axially offset from the protrusion, the axial stop element being configured to stop axial movement of the upper coupling element within the connector cap following failure of the protrusion.

22. The downhole system of claim 21, wherein the protrusion is at least one of a shearable ring, one or more shear pins, and one or more shear screws.

* * * * *